US009385482B2

(12) United States Patent
Li et al.

(10) Patent No.: US 9,385,482 B2
(45) Date of Patent: Jul. 5, 2016

(54) ELECTRICAL CONNECTOR WITH GROUNDING PLATE

(71) Applicant: HON HAI PRECISION INDUSTRY CO., LTD., New Taipei (TW)

(72) Inventors: Xin-Xin Li, Kunshan (CN); Qiu Qian, Kunshan (CN); Chun-Sheng Li, Kunshan (CN); Jian-Kuang Zhu, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/477,890

(22) Filed: Sep. 5, 2014

(65) Prior Publication Data

US 2015/0072546 A1 Mar. 12, 2015

(30) Foreign Application Priority Data

Sep. 6, 2013 (CN) ..... 2013 1 0401602

(51) Int. Cl.
*H01R 13/6585* (2011.01)

(52) U.S. Cl.
CPC ..... *H01R 13/6585* (2013.01)

(58) Field of Classification Search
CPC ..... H01R 13/6585; H01R 13/46
See application file for complete search history.

(56) References Cited

U.S. PATENT DOCUMENTS 4,907,979 A * 3/1990 Feldman ..... H01R 12/7088 361/775
5,183,405 A * 2/1993 Elicker ..... H01R 23/688 439/108
5,263,870 A * 11/1993 Billman ..... H01R 12/721 439/108
5,453,026 A * 9/1995 Ikegami ..... H01R 23/688 439/579
6,254,405 B1 * 7/2001 Hung ..... H01R 23/688 439/101
6,290,515 B1 * 9/2001 Lee ..... H01R 23/688 439/108
6,699,077 B1 * 3/2004 Liu ..... H01R 24/64 439/676
6,835,092 B2 * 12/2004 Wan ..... H01R 13/6658 439/541.5
7,758,379 B2 * 7/2010 Chen ..... H01R 13/6485 439/607.11

(Continued)

FOREIGN PATENT DOCUMENTS

| | | |
|---|---|---|
| TW | 374508 | 11/1999 |
| TW | M367498 | 10/2009 |
| TW | M395926 U | 1/2011 |

*Primary Examiner* — Briggitte R Hammond
(74) *Attorney, Agent, or Firm* — Wei Te Chung; Ming Chieh Chang

(57) ABSTRACT

An electrical connector assembly includes a first electrical connector and a second electrical connector mated with each other. The first electrical connector includes an insulative housing, a plurality of conductive terminals and a grounding plate. The insulative housing extending along a longitudinal direction includes a base portion and a plurality of side walls extending forwardly from the base portion and forming a mating cavity. The insulative housing defines a plurality of first passageways and second passageways separately formed in two opposite side walls thereof communicating with the mating cavity. The conductive terminals include a plurality of first terminals and second terminals received in the corresponding first and second passageways. Each of the first and second terminals has a contact portion extending into the mating cavity. The grounding plate is disposed between the first and second terminals and defines at least one pressing portion located in the mating cavity.

14 Claims, 5 Drawing Sheets

(56) References Cited

U.S. PATENT DOCUMENTS 8,221,139 B2 * 7/2012 Qin ..... H01R 13/6471 439/92
8,262,411 B2 * 9/2012 Kondo ..... H01R 13/6658 439/607.01
8,702,451 B2 * 4/2014 Luo ..... H01R 12/725 439/607.28
8,764,460 B2 * 7/2014 Smink ..... H01R 13/6597 439/92
2009/0221165 A1 * 9/2009 Buck ..... H01R 13/514 439/108
2010/0267261 A1 * 10/2010 Lin ..... H01R 13/6461 439/218
2011/0269346 A1 * 11/2011 Casher ..... H01R 29/00 439/626
2012/0108109 A1 * 5/2012 Zhang ..... H01R 12/721 439/629
2012/0184134 A1 * 7/2012 Zhao ..... H01R 12/592 439/579
2012/0184145 A1 * 7/2012 Zeng ..... H01R 13/6585 439/626
2012/0202363 A1 * 8/2012 McNamara ..... H01R 13/6461 439/74
2013/0288513 A1 * 10/2013 Masubuchi ..... H01R 12/775 439/386
2013/0316581 A1 * 11/2013 Kao ..... H01R 13/6471 439/607.28
2014/0248785 A1 * 9/2014 Little ..... H01R 13/658 439/95
2015/0056827 A1 * 2/2015 Gao ..... H01R 13/6587 439/78
2015/0072546 A1 * 3/2015 Li ..... H01R 13/6585 439/96

* cited by examiner

ELECTRICAL CONNECTOR WITH GROUNDING PLATE

BACKGROUND OF THE INVENTION

1. Field of the Invention

The present invention generally relates to an electrical connector, and more particularly to an electrical connector with a grounding plate secured therein.

2. Description of Related Art

TW patent No. M367498 discloses an electrical connector comprising an insulator, a plurality of ESATA terminals, a plurality of USB terminals and a grounding plate. The insulator defines a receptacle space running through the front face thereof and a mating tongue extending into the receptacle space along a first orientation. The mating tongue defines a first face and a second face opposite to the first surface. Each of the ESATA terminals has a contact section disposed in the first face of the mating tongue, and each of the USB terminals has a contact section disposed in the second face of the mating tongue. The grounding plate is disposed between the first and second faces of the mating tongue, and is spaced with the ESATA and USB terminals by the mating tongue. The disposition of the grounding plate efficiently prevents the electromagnetic interference of the ESATA and USB terminals. However, with the continuously development of the high frequency transmission, the signal interference between terminals is becoming obvious.

In view of the foregoing, an electrical connector with a grounding plate coupled therein is able to resolve the problem described aforementioned would be desirable.

SUMMARY OF THE INVENTION

Accordingly, an object of the present invention is to provide an electrical connector, the electrical connector has a grounding plate secured therein and used for providing good anti-electromagnetic interference ability.

In order to achieve the object set forth, an electrical connector comprises an insulative housing, a plurality of conductive terminals secured in the insulative housing and a grounding plate. The insulative housing extends along a longitudinal direction and has a base portion and a mating cavity extending forwardly from the base portion. The insulative housing defines a plurality of first passageways and second passageways separately formed in two opposite side walls communicating with the mating cavity. The conductive terminals have a plurality of first terminals and second terminals received in the corresponding first and second passageways. Each of the first and second terminals has a contact portion extending into the mating cavity. The grounding plate is disposed between the first and second terminals and defines at least one pressing portion located in the mating cavity.

In order to achieve the object set forth, an electrical connector assembly comprising a first electrical connector and a second electrical connector mated with each other. The first electrical connector includes an insulative housing, a plurality of conductive terminals secured in the insulative housing and a grounding plate. The insulative housing defines a lengthwise mating cavity, and the mating cavity runs through a front surface of the insulative housing and a inner surface of the mating cavity opposite to the front surface. The conductive terminals is disposed along a longitudinal direction, each of conductive terminals has a contact portion extending into the mating cavity and a soldering portion extending out of the insulative housing. The second electrical connector has a conductive mating portion inserted into the mating cavity.

The grounding plate is secured in the insulative housing and defines at least one pressing portion disposed on the inner surface of the mating cavity.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
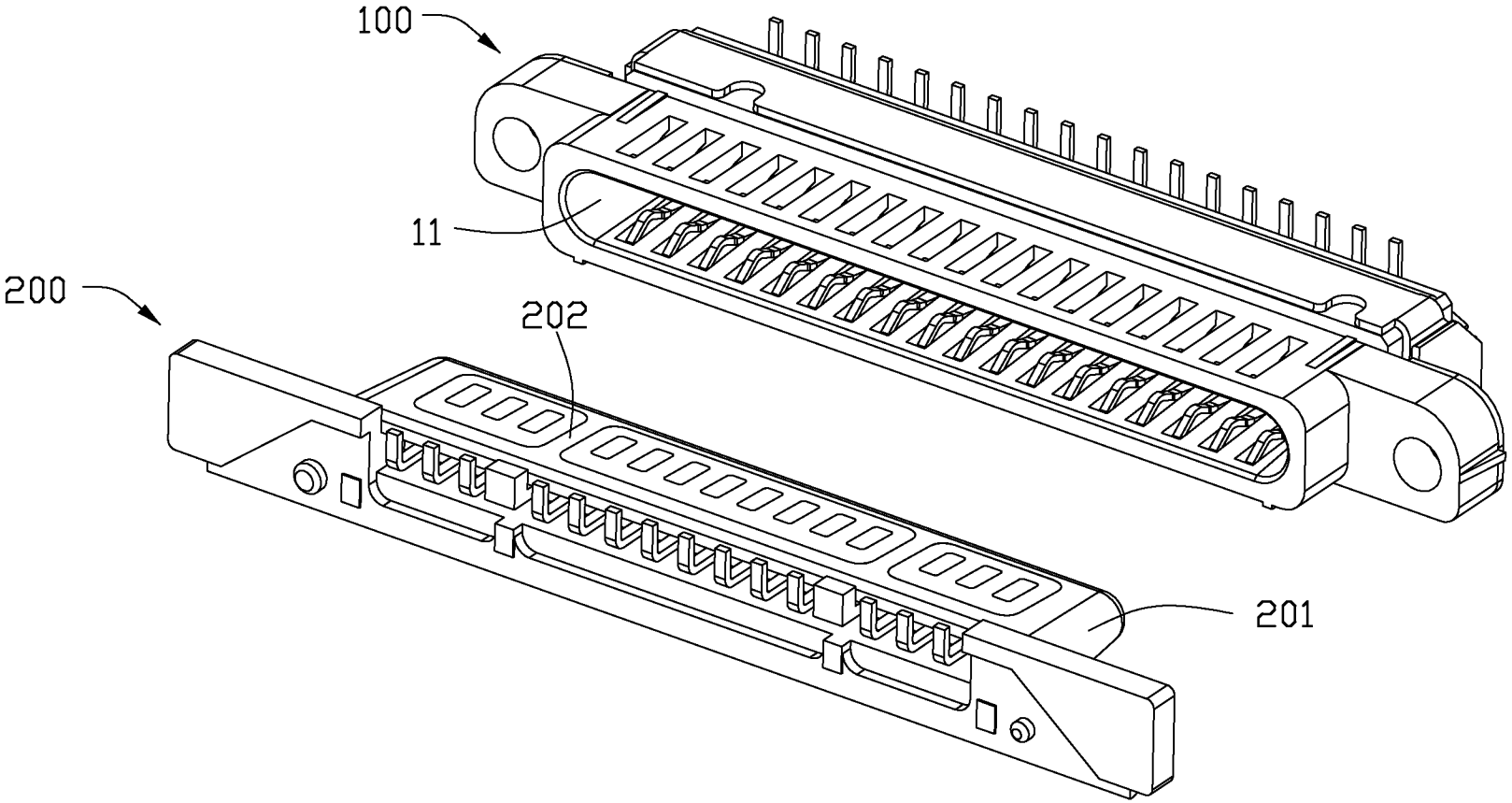
FIG. 1 is a perspective view of an electrical connector assembly of the present invention, the electrical connector assembly includes a first electrical and a second electrical connector.

Referring to FIG. 1, the present invention provides an electrical connector assembly with good anti-electromagnetic interference ability. The electrical connector assembly comprises a first electrical connector (or electrical connector) 100 and a second electrical connector (or complementary connector) 200 mated with each other. The first electrical connector 100 defines a lengthwise mating cavity 11 extending along a longitudinal direction, and the second electrical connector 200 has a mating portion 202 formed as part of a metal shell 201 intended to be inserted into the mating cavity 11. The mating portion 202 is a conductive configuration.

Figure 2:
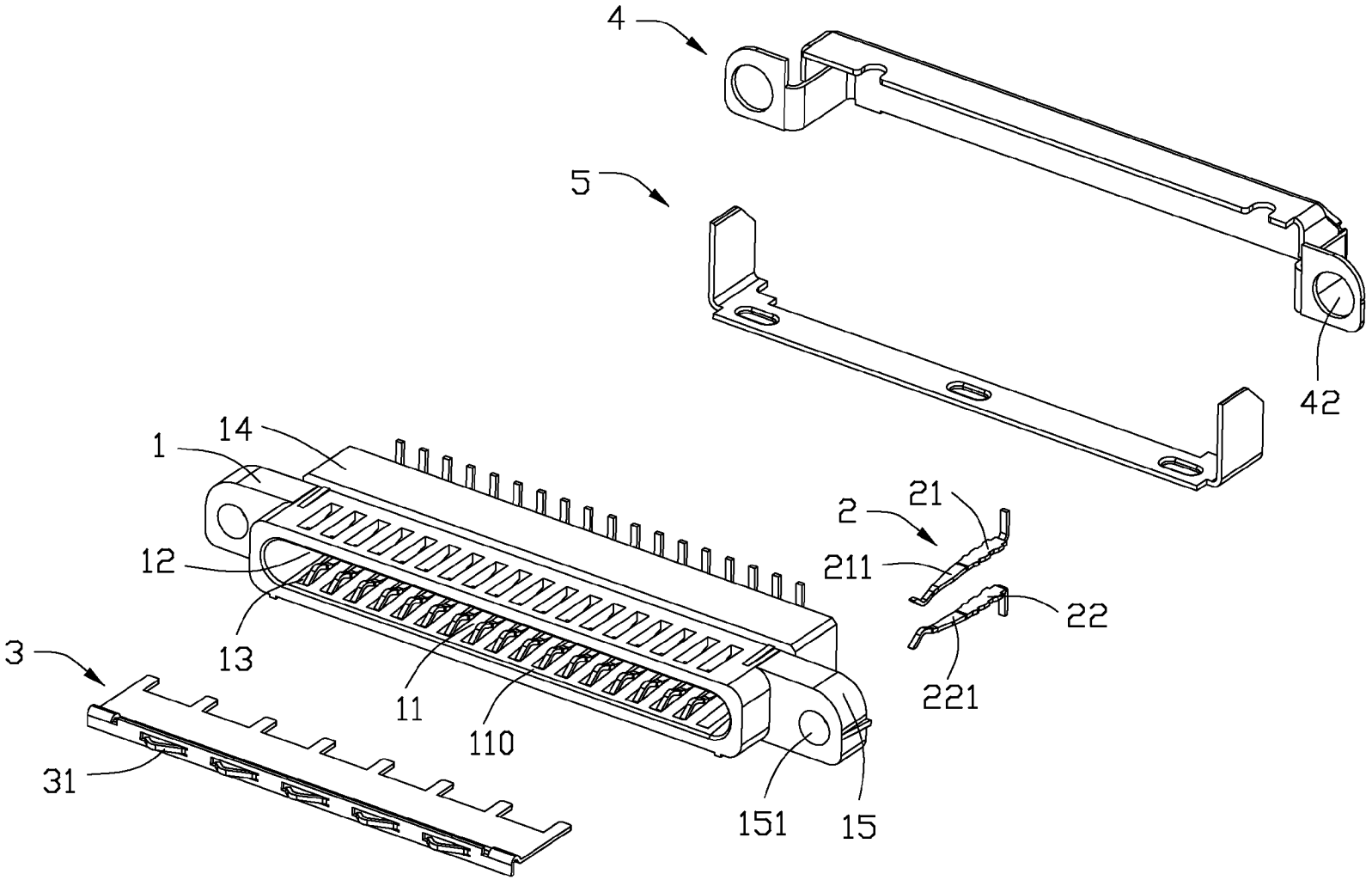
FIG. 2 is an exploded perspective view of a first electrical connector in FIG. 1.
Figure 5:
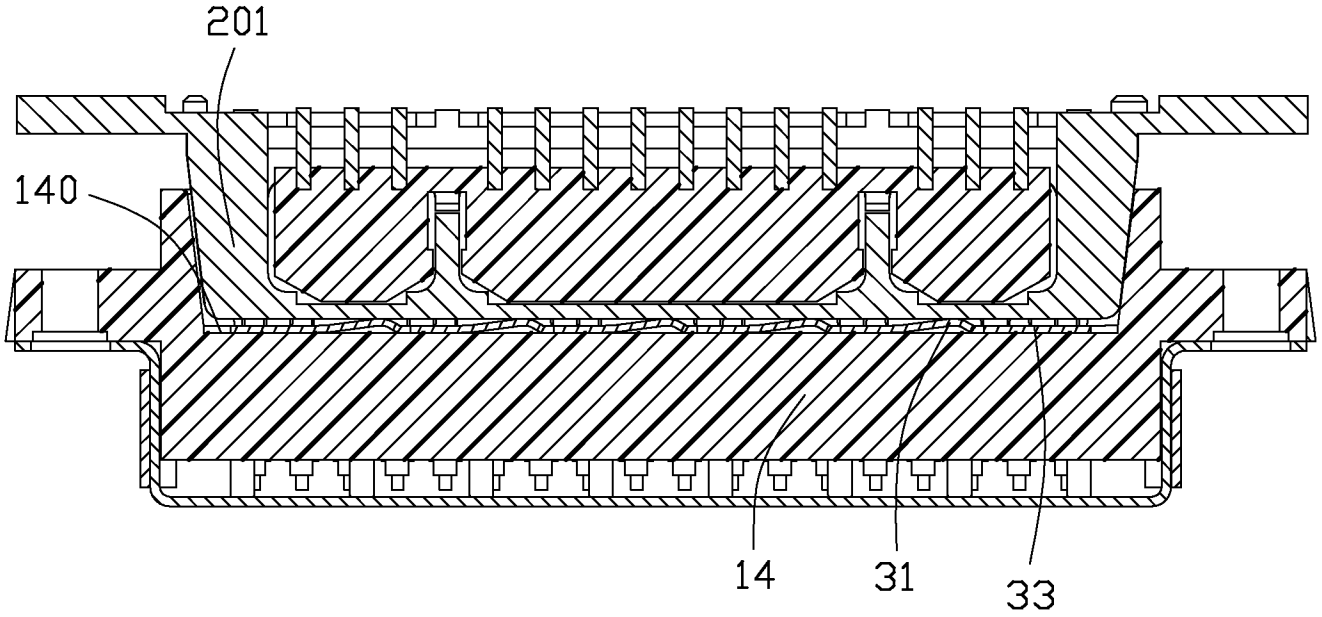
FIG. 5 is a sectional perspective view of the first electrical connector mated with the second electrical connector in FIG. 1.

Referring to FIG. 2, the first electrical connector 100 comprises an insulative housing 1, a plurality of conductive terminals 2 installed in the insulative housing 1 and a grounding plate 3 secured in the insulative housing 1. The insulative housing 1 includes a base portion 14, two opposite side walls extending forwardly from a front face 140 of the base portion 14 and two end walls connecting with the two side walls. The four walls surround to form the mating cavity 11 aforementioned used for receiving the second connector 200. The insulative housing 1 defines a plurality of first passageways 12 and second passageways 13 separately formed on the inner surfaces of the two opposite side walls thereof, respectively and communicating with the mating cavity 11. The first and second passageways 12, 13 separately run through the corresponding side walls. The conductive terminals 2 are disposed along a longitudinal direction and are separated into two rows so as to form one row of first terminals 21 and another row of second terminals 22 respectively received in the corresponding first and second passageways 12, 13, thereby the first and second terminals 21, 22 are respectively disposed in two opposite sides of the mating cavity 11. Conjoined with FIG. 3, each of the first terminals 21 comprises a first contacting section 212 protruding into the mating cavity 11 and a first retaining section 211 retained in the base portion 14. And each of the second terminals 22 comprises a second contacting section 222 protruding into the mating cavity 11 and a second retaining section 221 retained in the base portion. The grounding plate 3 is disposed between the rows of first and second terminals 21,22 and has at least one pressing portion 31 protruding into the mating cavity 11 which is used for contacting with the mating portion 202 of the second connector 200. There are a plurality of pressing portion 31 defined in the present embodiment. As illustrated in FIG. 5, the front face 140 of the base portion 14 of the insulative housing 1 is partly exposed to the mating cavity 11.

Figure 3:
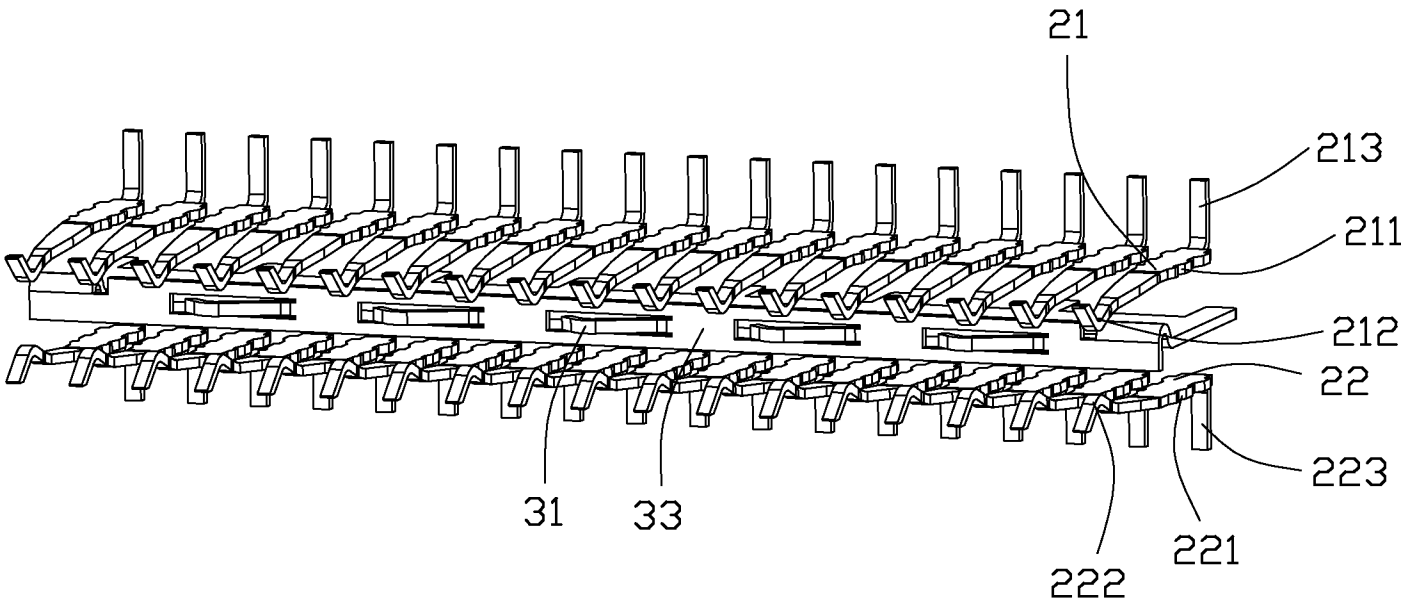
FIG. 3 is a perspective view of a grounding plate, a plurality of first terminals and a plurality of second terminals of the first electrical connector in FIG. 1.

Referring to FIG. 3, the grounding plate 3 is retained in the base portion 14 of the insulative housing 1 and is disposed between the first and second retaining sections 211, 221. The first retaining section 211 of each first terminals 21 bends from an end of the first terminal opposite to the first contacting section 212 to form a first connecting section 213 protruding out of the insulative housing 1, and the second retaining section 221 of each second terminals 22 bends from an end of the second terminal opposite to the second contacting section 222 to form a second connecting section 223. The disposition of the first and the second connecting sections 213, 223 are used for making the first connector 100 coupled a the printed circuit board (not labeled).

Referring to FIG. 2, the first electrical connector 100 further includes a first shield shell 4 and a second shield shell 5 shielding the insulative housing 1. The first and second shield shell 4, 5 are connected with each other by spot welding. The insulative housing 1 has two ear portions 15 respectively extending outwardly from two end walls thereof, and each of the ear portions 15 defines a first hole 151 running through the ear portion 15. The first shield shell 4 further defines two second holes 42 corresponding to the first hole 151.

Besides, the mating cavity 11 forms an insertion opening 110 in the front portion for an insertion of the second electrical connector 200. As illustrated in FIG. 5, the mating cavity 11 has a trapezoid shape with a wider side near the insertion opening 110 taken from a top side view. That is to say, the dimension of the mating cavity 11 along the longitudinal direction increases along a back to front direction. The mating cavity 11 runs through the front surface of the insulative housing 1 and an inner surface thereof opposite to the front surface. The shape of the mating portion 202 of the metal shell 201 is approximately the same as the shape of the mating cavity 11.

Figure 4:
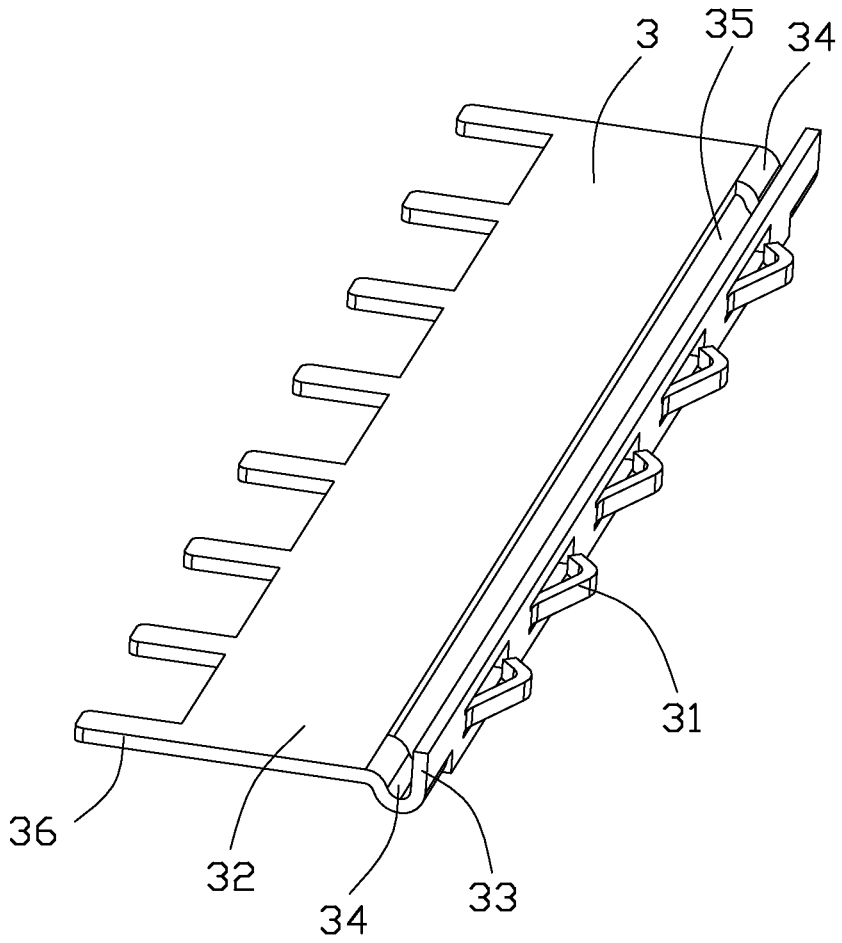
FIG. 4 is a perspective view of the grounding plate of the first electrical connector in FIG. 1.

Referring to FIG. 4, the grounding plate 3 is configured as L-shaped taken from a side view, and comprises a flat body portion 32, a vertical head portion 33 bending from a front end of the body portion 32 and facing to the mating cavity 11 and a plurality of connecting legs 36 extending out of the insulative housing 1 from the other end opposite to the head portion 33. The body portion 32 is retained in the base portion 14 of the insulative housing 1. The grounding plate 3 has a plurality of elastic pressing plate extending into the mating cavity 11 from the head portion 33. The elastic pressing plate is disposed in one row along the longitudinal direction, and all the elastic pressing plates are in the same extending orientation. The elastic pressing plates form the pressing portions 31 aforementioned. As illustrated in FIG. 5, the grounding plate 3 is secured in the insulative housing 1 and comprises the pressing portions 31 disposed in the mating cavity 11. When the first and second electrical connectors 100, 200 are mated with each other, the pressing portions 31 will be pressed to transfer rearwardly to the head portion 33 by the second electrical connector 200.

Referring to FIG. 3, the head portion 33 of the grounding plate 3 is behind the first and second contacting sections 212, 222. The length of the body portion 32 and head portion 33 are in a same size along the lengthwise direction, and the length of the body portion 32 and the head portion 33 is approximately the same as the length of the rows of the first and second terminals 21, 22 along the longitudinal direction.

What's more, the grounding plate 3 has two curve portions 34 between the body portion 32 and the head portion 33, and the two curve portions 34 separately connects the two side ends of the body portion 32 and the head portion 33 along the longitudinal direction. The curve portions 34 are higher than the body portion 32. The body portion 32, the head portion 33 and two curve portions 34 of the grounding plate 3 surround to form a lengthwise hollow portion 35 embedded in the base portion 14 of the insulative housing 1. The head portion 33 is disposed in the mating cavity 11. The disposition of the hollow portion 35 is provided for the given away of the mould so as to stamp the pressing portion 31.

In conclusion, the disposition of the grounding plate 3 and the cooperation between the grounding plate 3 and the metal shell 201 of the second electrical connector 200 are benefit to prevent the signal interference between the first and second terminals 21, 22. A good grounding circuit path will be formed when the two electrical connector 100, 200 are mated with each other, thereby the effect of the anti-electromagnetic interference is obviously improved.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

an insulative housing, the insulative housing extending along a longitudinal direction and comprising a base portion and a plurality of side walls extending forwardly from the base portion and defining a mating cavity, the insulative housing defining a plurality of first passageways and second passageways separately formed at two opposite side walls thereof communicating with the mating cavity;

a plurality of conductive terminals secured in the insulative housing, the terminals comprising a plurality of first terminals and second terminals received in the corresponding first and second passageways, each of the first and second terminals comprising a contact portion extending into the mating cavity; and a grounding plate, the grounding plate retained to the insulative housing and disposed between the first and second terminals, the grounding plate defining at least one pressing portion forwardly extending into the mating cavity; wherein the grounding plate comprises a flat body portion and a head portion bending from one end of the body portion and facing to the mating cavity, the body portion is retained to the base portion, and the grounding plate has at least one elastic pressing plate extending from the head portion into the mating cavity, the elastic pressing plate form the pressing portion; wherein the flat body extends in a first plane and the head portion extends in a second plane perpendicular to said first plane.

2. The electrical connector as claimed in claim 1, wherein each of the first terminals has a first retaining section retained in the base portion, and each of the second terminals has a second retaining section retained in the base portion, the grounding plate is secured in the base portion and is located between the first and second retaining sections.

3. The electrical connector as claimed in claim 1, wherein the grounding plate has two curve portions between the body portion and the head portion, the two curve portions separately connects with the two side ends of the body portion and the head portion along the longitudinal direction, the body portion, the head portion and two curve portions of the grounding plate surround to form a lengthwise hollow portion embedded in the base portion of the insulative housing, the head portion is disposed in the mating cavity.

4. An electrical connector assembly comprising:

a first electrical connector comprising:

an insulative housing defining a lengthwise mating cavity, the mating cavity running through a front surface of the insulative housing and an inner surface of the mating cavity opposite to the front surface;

a plurality of conductive terminals disposed along a longitudinal direction, each of conductive terminals having a contact portion protruding into the mating cavity and a soldering portion extending out of the insulative housing; and a grounding plate;

a second electrical connector mated with the first electrical connector comprising:

a conductive mating portion inserted into the mating cavity;

wherein the grounding plate is secured in the insulative housing and has at least one pressing portion disposed on the inner surface of the mating cavity; wherein the grounding plate comprises a flat body portion and a head portion extending from the body portion to the mating cavity, the body portion is secured in the base portion, and the grounding plate defines a plurality of elastic pressing plates from the head portion to the mating cavity, the elastic pressing plate forms the pressing portion; wherein the body portion and the head portion of the grounding plate are connected by two curve portions at two opposite side ends thereof, and the curve portions are higher than the body portion.

5. The electrical connector assembly as claimed in claim 4, wherein the insulative housing comprises a base portion, the conductive terminals are separated into two rows at two opposite sides of the mating cavity, thereby forms one row of first terminals and another row of second terminals, each of the first terminals defines a first retaining portion retained in the base portion, and each of the second terminals defines a second retaining portion retained in the base portion, the grounding plate is secured in the base portion and located between the first and second retaining portions.

6. The electrical connector assembly as claimed in claim 4, wherein the elastic pressing plates are disposed in one row along the longitudinal direction, and all the elastic pressing plate are in the same extending direction.

7. The electrical connector assembly as claimed in claim 4, wherein the length of the mating cavity along the longitudinal direction increases along a back-to-front direction.

8. An electrical connector assembly comprising:

a first electrical connector including:

an insulative housing defining a mating cavity extending along a longitudinal direction and communicating with an exterior through a front opening along a front-to-back direction perpendicular to said longitudinal direction;

two rows of first contacts disposed in the insulative housing and located by two longitudinal sides of the mating cavity in a transverse direction perpendicular to both said longitudinal direction and said front-to-back direction; and a metallic shielding plate disposed in the insulative housing and between said two rows of first contacts in the vertical direction, said metallic shielding plate including a plate like front edge section located upon an inner face of the housing which is located behind and exposed to the mating cavity and opposite to said front opening in said front-to-back direction; wherein the plate like front edge section is equipped with at least one resilient piece forwardly extending and rearwardly deflectable along said front-to-back direction; wherein said metallic shielding plate includes a flat body portion embedded within the housing in a first plane defined by the longitudinal direction and said front-to-back direction while the plate like front edge section extends in a second plane which is defined by said longitudinal direction and said transverse direction and is perpendicular to said first plane.

9. The electrical connector assembly as claimed in claim 8, wherein the metallic shielding plate includes a curved sections between said front edge section and said body portion.

10. The electrical connector assembly as claimed in claim 9, wherein the front edge section is essentially symmetric with regard to the body portion in said transverse direction.

11. The electrical connector assembly as claimed in claim 8, wherein the metallic shielding plate forms a rear section electrically and mechanically connected to a metallic shell enclosing a rear face of the insulative housing.

12. The electrical connector assembly as claimed in claim 8, further including a second electrical connector having a metallic shield enclosing an insulator with corresponding second contacts therein, wherein said metallic shield is received in the mating cavity with a front edge of said metallic shield mechanically and electrically connected to the resilient piece.

13. The electrical connector assembly as claimed in claim 12, wherein said first contacts are resilient while said second contacts are stationary.

14. The electrical connector assembly as claimed in claim 8, wherein there are more than one resilient pieces arranged along the front edge section in said longitudinal direction.

* * * * *